US008547304B2

(12) United States Patent
Ito

(10) Patent No.: US 8,547,304 B2
(45) Date of Patent: Oct. 1, 2013

(54) ELECTRO-OPTICAL DEVICE, DRIVING METHOD OF ELECTRO-OPTICAL DEVICE, AND ELECTRONIC APPARATUS

(75) Inventor: Akihiko Ito, Tatsuno-machi (JP)

(73) Assignee: Seiko Epson Corporation, Tokyo (JP)

( * ) Notice: Subject to any disclaimer, the term of this patent is extended or adjusted under 35 U.S.C. 154(b) by 717 days.

(21) Appl. No.: 12/351,682

(22) Filed: Jan. 9, 2009

(65) Prior Publication Data

US 2009/0179835 A1 Jul. 16, 2009

(30) Foreign Application Priority Data

Jan. 10, 2008 (JP) ..... 2008-003557

(51) Int. Cl.
*G09G 3/30* (2006.01)

(52) U.S. Cl.
USPC ..... 345/76

(58) Field of Classification Search
None
See application file for complete search history.

(56) References Cited

U.S. PATENT DOCUMENTS

| | | | | |
|---|---|---|---|---|
| 5,170,158 | A | 12/1992 | Shinya | |
| 6,850,305 | B2 * | 2/2005 | Hsieh et al. | 349/144 |
| 7,173,676 | B2 * | 2/2007 | Jeon et al. | 349/48 |
| 7,538,754 | B2 * | 5/2009 | Tsuda et al. | 345/100 |
| 7,903,053 | B2 * | 3/2011 | Kawasaki et al. | 345/76 |
| 7,907,131 | B2 * | 3/2011 | Su et al. | 345/204 |
| 7,944,414 | B2 * | 5/2011 | Shirasaki et al. | 345/77 |
| 8,139,052 | B2 * | 3/2012 | Ito | 345/204 |
| 2007/0195041 | A1 | 8/2007 | Lee | |

FOREIGN PATENT DOCUMENTS

| | | | |
|---|---|---|---|
| JP | 03-121415 | A | 5/1991 |
| JP | 08-334743 | A | 12/1996 |
| JP | 09-081087 | A | 3/1997 |
| JP | 11-119736 | A | 4/1999 |
| JP | 2005-43417 | A | 2/2005 |
| JP | 2007-226196 | A | 9/2007 |

* cited by examiner

*Primary Examiner* — K. Wong
(74) *Attorney, Agent, or Firm* — ALG Intellectual Property, LLC

(57) ABSTRACT

An electro-optical device includes a pixel column, a first and second data lines, and a first and second output circuits. The pixel column including pixel portions are arranged in a first direction. The first and second data lines extend in the first direction. The first and second output circuits output data voltages to different pixel portions of the pixel column through the first and second data lines, respectively.

20 Claims, 9 Drawing Sheets

ELECTRO-OPTICAL DEVICE, DRIVING METHOD OF ELECTRO-OPTICAL DEVICE, AND ELECTRONIC APPARATUS

BACKGROUND

1. Technical Field

The present invention relates to an electro-optical device, such as a liquid crystal display device, a driving method of an electro-optical device, and an electronic apparatus, such as a projector.

2. Related Art

As electro-optical devices, there is known an electro-optical device including an electro-optical panel which performs electro-optical operation, such as displaying in a pixel area, and a flexible substrate on which a drive integrated circuit which functions as at least part of a drive circuit for driving a device is formed. Such a structure of the electro-optical device enables the electro-optical panel to be realized in a small size and can make a ratio of a pixel area to the total size of the electro-optical panel increase by separating part of a control circuit from the electro-optical panel.

JP-A-2005-43417 discloses a technique in which a drive integrated circuit of an electro-optical panel is provided on a flexible substrate by a packaging technique, such as Chin On Film (COF) and data voltages are sequentially outputted to the electro-optical panel.

However, this technique gives rise to a problem such that the data voltages output from a plurality of amplifiers included in the drive integrated circuit show variance among amplifiers when driving the electro-optical panel with the data voltages output from the drive integrated circuit. The variance of the data voltages may be a factor of causing luminance unevenness in a displayed image. That is, the above-mentioned technique has a technical problem in that image quality deteriorates due to variance of data voltages.

SUMMARY

An advantage of some aspects of the invention is to provide an electro-optical device, a driving method of an electro-optical device, and an electronic apparatus which can reduce display unevenness attributable to voltage variance and enables a high quality image to be displayed.

According to one aspect of the invention, there is provided an electro-optical device including a substrate, a plurality of pixel portions arranged on the substrate in a first direction and a second direction which intersects the first direction, a plurality of data lines arranged on the substrate in the first direction, and a plurality of output circuits which outputs data voltages to the plurality of pixel portions via the plurality of data lines, in which a pixel column made up of some pixel portions arranged in the first direction of the plurality of pixel portions are applied with the data voltages from at least two different output circuits of the plurality of output circuits.

With such a structure, first data voltages are output from the output circuits via the plurality of data lines during the operation. The "data voltage" means a voltage having data for displaying an image. That is, the data voltage is also called image signal. The output circuit is an amplifying circuit, such as an operational amplifier (Op Amp) and amplifies and outputs the data voltage. The output circuit typically forms as part of an integrated circuit, and is placed on the flexible substrate electrically connected to a substrate on which the pixel portions are arranged. The output circuit also can be placed on the substrate on which the pixel portions are arranged.

The data voltages output from the plurality of data lines are supplied to the plurality of pixel portions arranged on the substrate. The data voltages are supplied to the plurality of pixel portions in response to scan signals supplied from scan lines. Thus, an active matrix-type image display is performed. The pixel portions include transparent electrodes made of a transparent conductive material, such as Indium Tin Oxide (ITO) and are arranged in the first direction in which the data lines are arranged and the second direction which intersects the first direction. That is, the plurality of pixel portions is arranged in a matrix on the substrate.

In the electro-optical device, it is preferable that the pixel column made up of pixel portions arranged in the first direction among the plurality of pixel portions is applied with the data voltage output from at least two different output circuits of the plurality of output circuits. In greater detail, two data lines and two output circuits are provided to correspond to one pixel column. The data voltages output from two output circuits are supplied to different pixel portions in the same pixel column via different data lines, respectively.

The data voltages output from the plurality of output circuits may have variance. For example, when it is supposed that the same value of data voltages is output from different output circuits, the voltages output from the different output circuits may have variance. For this instance, in the case in which a single pixel column is supplied with the data voltage output from only a single output circuit, the pixel columns supplied with the data voltage may show voltage variance. That is, luminance variance between pixel columns occurs. As a result, display unevenness in a line form in the data line direction occurs.

However, with this invention, as described above, a single pixel column is supplied with data voltages output from at least two different output circuits. Accordingly, it is possible to suppress line-shaped display unevenness attributable to data voltage variance between output circuits. Further, in the case in which the pixel column is supplied with the data voltages from at least two different output circuits, data voltage variance between the output circuits can occur. However, luminance variance occurring between pixel portions is not observed between the pixel columns. That is, since the pixel portions having luminance variance are not arranged in a row or column, it is possible to reduce the display unevenness so that a viewer cannot visually feel the display unevenness at all or almost.

As described above, according to the electro-optical device of the invention, it is possible to reduce display unevenness attributable to data voltage variance. Accordingly, it is possible to display a high quality image.

In the electro-optical device, it is preferable that the at least two output circuits simultaneously output the data voltages with respect to the pixel portions included in the pixel column.

According to this aspect, the data voltages output from the at least two output circuits which output the data voltages with respect to one pixel column are simultaneously output to the pixel portions in the pixel column. That is, the pixel portions included in a single pixel column are simultaneously applied with data voltages from different amplifiers.

For example, in the case in which one pixel column is supplied with the data voltage from only a single output circuit, the pixel portions belonging to the pixel column are applied with the data voltages in turns one by one. However, when supplying the data voltages to the single pixel column using at least two output circuits, it is possible to simultaneously supply the data voltages to at least two pixel portions. Accordingly, it is possible to shorten a writing period for writing data into the pixel portions. For example, an image of a single frame can be displayed in a shorter time. Accordingly, it is possible to display a high quality image.

In the electro-optical device, it is preferable that the at least two output circuits output the data voltages to the pixel portions neighboring one another of the pixel portions belonging to the pixel column, respectively.

With such a structure, data voltages are output to the neighboring pixel portions of the pixel portions belonging to the pixel column from the at least two output circuits which output data voltages to a single pixel column. For example, in the case in which a single pixel column is supplied with the data voltages by two output circuits, a pixel portion to which a data voltage is supplied by one output circuit of the two output circuits and a pixel portion to which a data voltage is supplied by the other output circuit of the two output circuits are adjacent to one another. In other words, the pixel portions applied with data signals from one output circuit of the two output circuits are not adjacent to one another, and the pixel portions applied with data signals from the other output circuit of the two output circuits are not also adjacent to one another. That is, the pixel portions of the single pixel column which is arranged in the first direction are supplied with alternate data voltages from different output circuits.

Since the data voltages are supplied in the above-mentioned manner, the pixel portions having luminance unevenness attributable to data voltage variance are alternately arranged in the single pixel column. Accordingly, the display unevenness attributable to the luminance unevenness may not visually stand out. Accordingly, it is possible to obtain a high quality image.

In the electro-optical device, it is preferable that each of the plurality of output circuits outputs the data voltage to the plurality of pixel columns.

With such a structure, the data voltages are outputted to the plurality of pixel columns from a single output circuit. In greater detail, a single output circuit is provided so as to correspond to a plurality of data lines, and the data voltages output from the single output circuit are supplied to the pixel columns while changing the data lines by a switch circuit (or a changeover circuit).

Since the data voltages are supplied in the above-mentioned manner, it is possible to reduce the total number of output circuits. In other words, it is possible to prevent the number of output circuits from increasing in even the case in which the number of pixel columns increases to respond to higher definition demand. Particularly in the case in which data voltages are output from at least two different output circuits, such an advantage is most effective.

In the electro-optical device, it is preferable that the at least two output circuits be included in different integrated circuits, respectively.

With such a structure, the at least two output circuits which output the data voltages to the single pixel column are included in different integrated circuits, respectively. That is, with this aspect of the invention, the electro-optical device is driven by a plurality of integrated circuits and the data voltages from different integrated circuits are supplied to the single pixel column.

As for the data voltage variance among output circuits, the variance of outputs from the different integrated circuits is typically greater than the variance of outputs from the single integrated circuit. Accordingly, as described above, when driving the electro-optical device by a plurality of integrated circuits, luminance difference existing in a plurality of pixel portions is most likely to occur.

In the electro-optical device, it is preferable that the data voltages from at least two output circuits be supplied to a single pixel column. Accordingly, it is possible to reduce the display unevenness attributable to the data voltage variance. Therefore, it is possible to display a high quality image.

According to another aspect of the invention, there is provided an electronic apparatus equipped with the above-mentioned electro-optical device.

According to the electronic apparatus of the invention, since the electronic apparatus includes the electro-optical device according to the above-mentioned invention, it is possible to reduce the display unevenness attributable to the data voltage unevenness. Accordingly, it is possible to realize various kinds of electronic apparatuses which can display a high quality image, such as a projection display apparatus, a television set, a cellular phone, an electronic organizer, a word processor, a viewfinder-type or monitor-type video recorder, a workstation, a television phone, a POS terminal, and a touch panel. The electronic apparatus according to the invention also may be an electrophoresis device, such as electronic paper.

According to a further aspect of the invention, there is provided a driving method of an electro-optical device having a substrate, a plurality of pixel portions arranged on the substrate in a first direction and a second direction which intersects the first direction, a plurality of data lines provided on the substrate and arranged in the first direction, and a plurality of output circuits which outputs data voltages to the plurality of pixel portions via the plurality of data lines, respectively. The driving method includes a step of supplying the data voltages output from at least two different output circuits of the plurality of output circuits to a pixel column made up of pixel portions arranged in the first direction of the plurality of pixel portions.

According to the driving method of an electro-optical device of the invention, data voltages output from at least two different output circuits of a plurality of output circuits are supplied to a single pixel column. Accordingly, it is possible to reduce display unevenness attributable to data voltage variance like the electro-optical device according to the above-mentioned invention. Therefore, it is possible to display a high quality image.

The driving method of an electro-optical device of the invention can adopt the above-mentioned aspects and forms of the electro-optical device of the invention.

Advantages and effects of the invention will be apparent from the following preferred embodiments.

BRIEF DESCRIPTION OF THE DRAWINGS

The invention will be described with reference to the accompanying drawings, wherein like numbers reference like elements.

DESCRIPTION OF EXEMPLARY EMBODIMENTS

Embodiments of the invention will be described below with reference to the accompanying drawings.

Electro-Optical Device

An electro-optical device according to one embodiment of the invention will be described with reference to FIGS. 1 to 9. Hereinafter, a liquid crystal device driven by a thin film transistor (TFT) active matrix-type driving method will be exemplified as an example of the electro-optical device.

Figure 1:
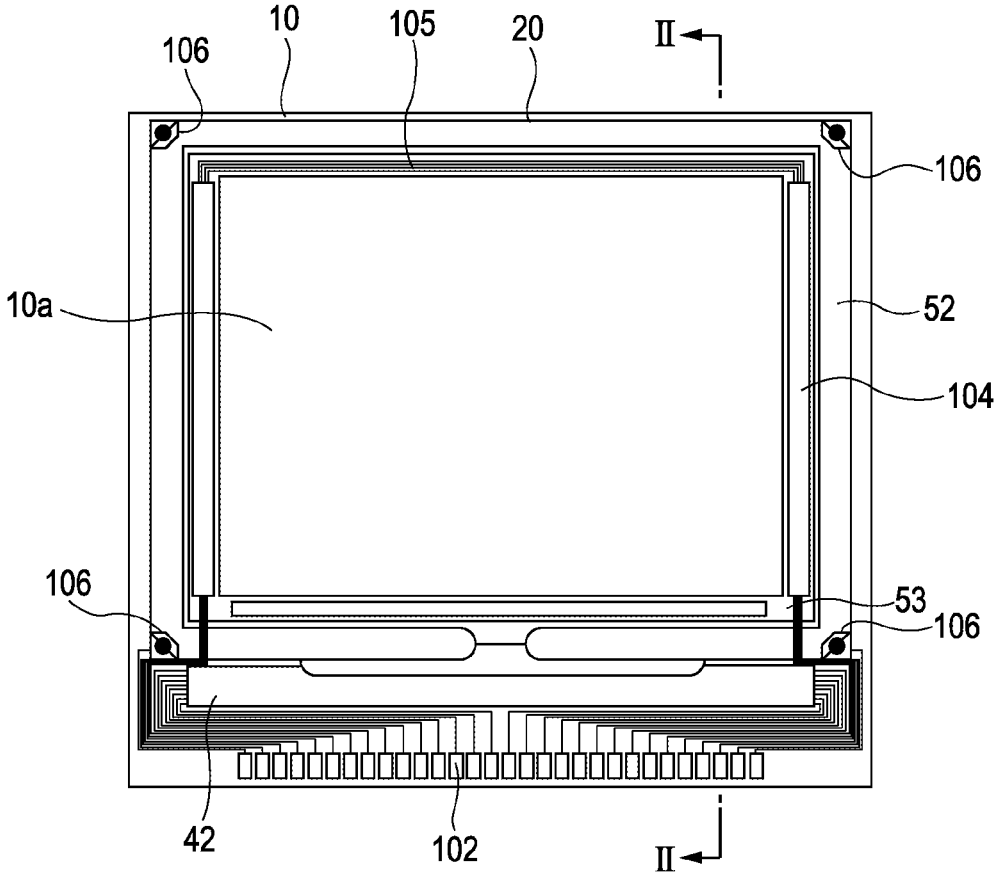
FIG. 1 is a plan view illustrating a structure of an electro-optical panel.

First, a structure of the electro-optical panel in the electro-optical device according to one embodiment will be described with reference to FIGS. 1 and 2. FIG. 1 is a plan view illustrating a structure of the electro-optical panel in the electro-optical device according to one embodiment of the invention, and FIG. 2 is a sectional view taken along line II-II of FIG. 1.

Figure 2:
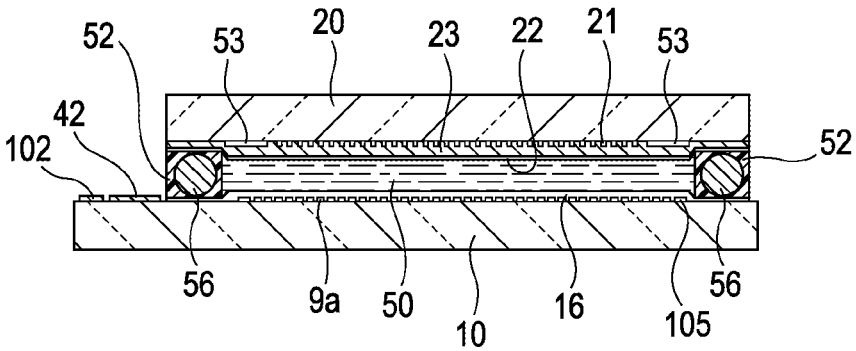
FIG. 2 is a sectional view taken along II-II of FIG. 1.

In FIGS. 1 and 2, in the electro-optical panel according to one embodiment of the invention, a TFT array substrate 10 and an opposing substrate 20 are placed to face one another. The TFT array substrate 10 is an example corresponding to the term "substrate" and may be, for example, a transparent substrate, such as quartz substrate and glass substrate, or a silicon substrate. The opposing substrate 20 is a transparent substrate, such as quartz substrate and glass substrate. A liquid crystal layer 50 is sealed between the TFT array substrate 10 and the opposing substrate 20. The TFT array substrate 10 and the opposing substrate 20 are bonded to one another by a sealing member 52 provided at a sealing area which is around an image display area 10*a* in which a plurality of pixel electrodes is provided.

The sealing member 52 is made of, for example, ultraviolet ray curable resin or heat curable resin for bonding both substrates to one another, and is a member that can be obtained as it is cured by ultraviolet ray or heat after the resin is coated on the TFT array substrate 10 in a manufacturing process. Gap members, glass fiber or glass beads are dispersed in the sealing member 52 in order to maintain a predetermined gap (i.e. inter-substrate gap) between the TFT array substrate 10 and the opposing substrate 20.

A frame-shaped light shielding film 53 which defines an image display area 10*a* disposed inside a sealing area, at which the sealing member 52 is placed, is provided on the opposing substrate 20 side. Part or the entire portion of the frame-shaped light shielding film 53 may be disposed on the TFT array substrate 10 side.

Of peripheral areas, a time division circuit 42 and external circuit connection terminals 102 are provided along a first edge of the TFT array substrate 10 at an area disposed outside the sealing area at which the sealing member 52 is placed. A scan line drive circuit 104 is provided so as to cover the frame-shaped light shielding film 53 along two edges adjacent to the first edge. Further, a plurality of wirings 105 is provided so as to cover the frame-shaped film 53 along the rest edge of the TFT array substrate 10 in order to connect two scan line drive circuits 104 provided at both sides of the image display area 10*a* to one another.

On the TFT array substrate 10, interlayer conduction terminals 106 for connecting the substrates to one another by interlayer conduction members 107 are placed at positions facing four corners of the opposing substrate 20, respectively. With such a structure, it is possible to enable the TFT array substrate 10 and the opposing substrate 20 to be electrically conducted.

In FIG. 2, an aligning film is formed on pixel electrodes 9*a* provided on the TFT array substrate 10 in the state in which TFTs for performing pixel switching, scan lines, and data lines are formed on the TFT array substrate 10. The pixel electrodes 9*a* is made of a transparent conductive film, such as ITO film, and the aligning film is made of an organic film, such as a polyimide film. On the other hand, an opposing electrode 21 is provided on the opposing substrate 20 after a light shielding film 23 is formed in a lattice form or a striped form so as to extend over the entire area of the opposing substrate 20. An aligning film is formed as the uppermost film on the opposing substrate 20. The opposing electrode 21 is made of a transparent conductive film, such as ITO. The aligning film is made of an organic film, such as polyimide film. The liquid crystal layer 50 is formed between the TFT array substrate 10 and the opposing substrate 20 placed in a manner such that the pixel electrodes 9*a* and the opposing electrode 21 face one another and structured in the above-described manner. The liquid crystal layer 50 is made up of liquid crystals in which one kind or several kinds of magnetic liquid crystals are mixed, and the liquid crystals are aligned in a predetermined orientation between a pair of aligning films.

As shown in FIGS. 1 and 2, besides the time division circuit 42 and drive circuits, such as the scan line drive circuit 104, on the TFT array substrate 10 is provided a sampling circuit which samples image signals from image signal lines and supplies them to the data lines, a pre-charge circuit which supplies a pre-charge signal having a predetermined voltage level to the plurality of data lines before the image signals are supplied to the data lines, and a test circuit which tests quality and defects of the corresponding electro-optical device which is being manufactured or shipped.

First Embodiment

Figure 3:
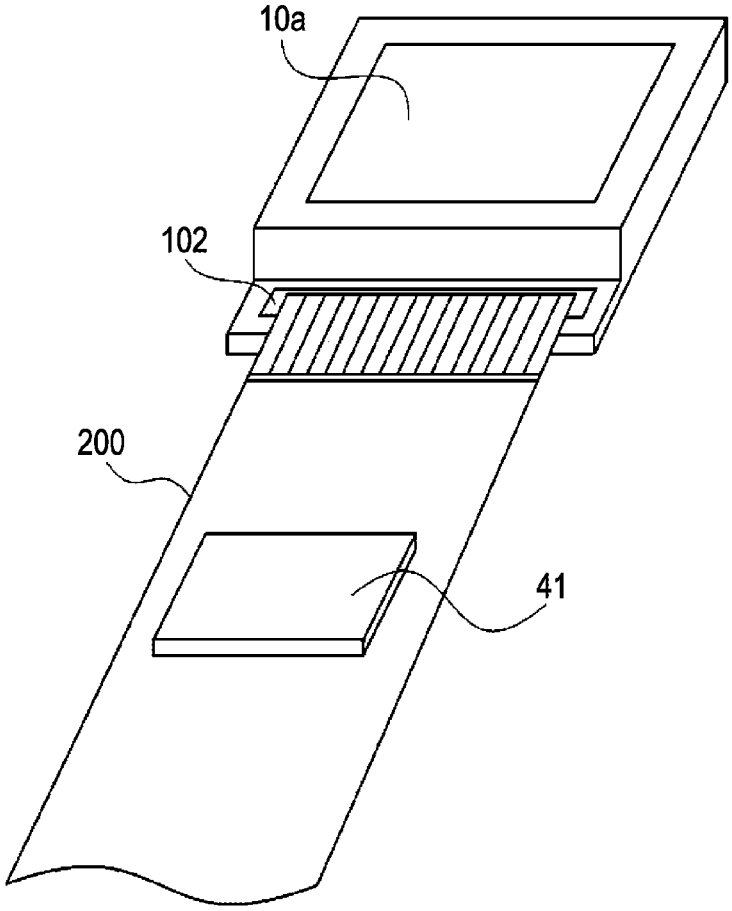
FIG. 3 is a perspective view illustrating an entire structure of an electro-optical device according to a first embodiment.
Figure 4:
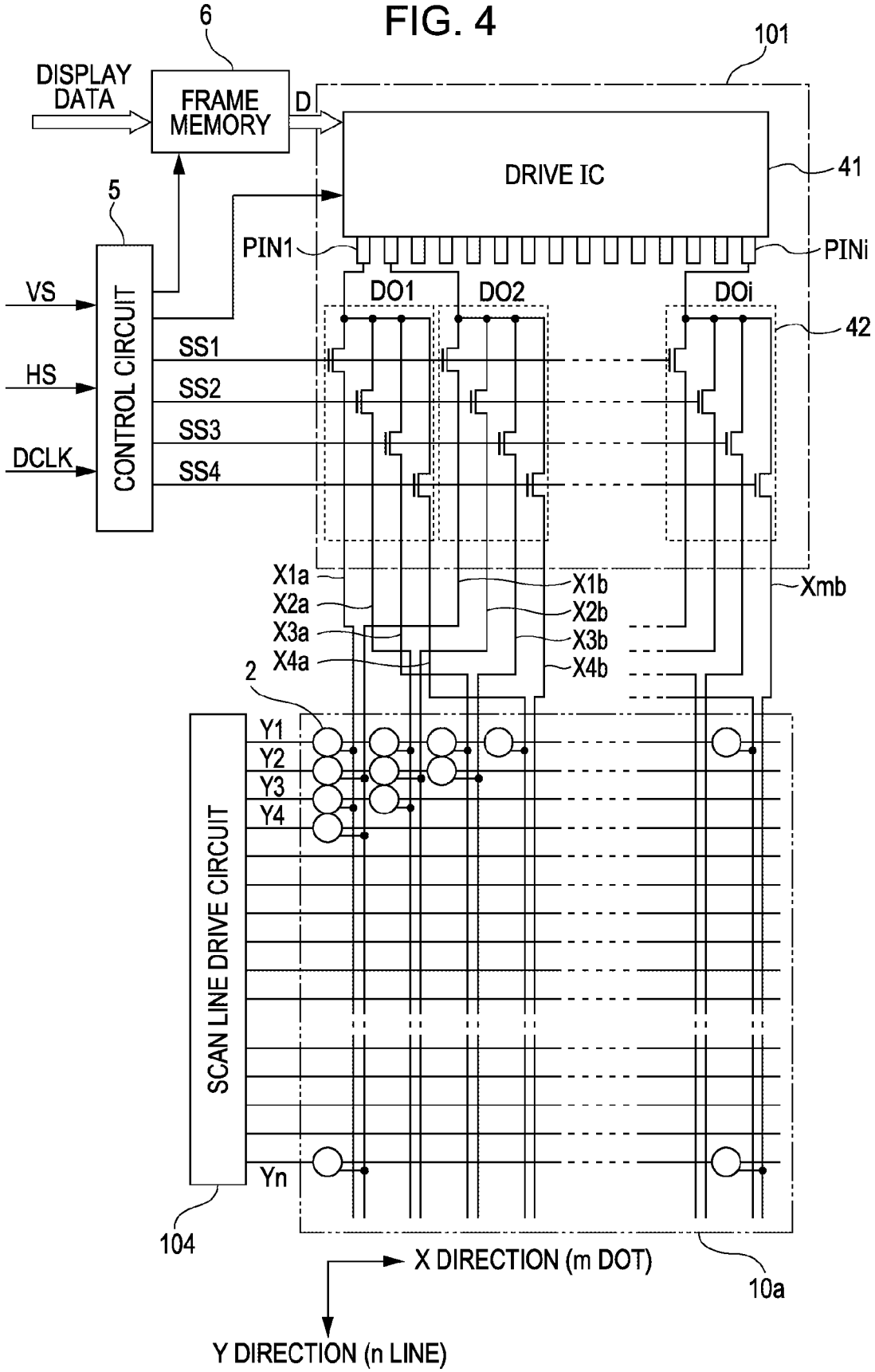
FIG. 4 is a circuit diagram illustrating a concrete structure of the electro-optical device according to the first embodiment.
Figure 5:
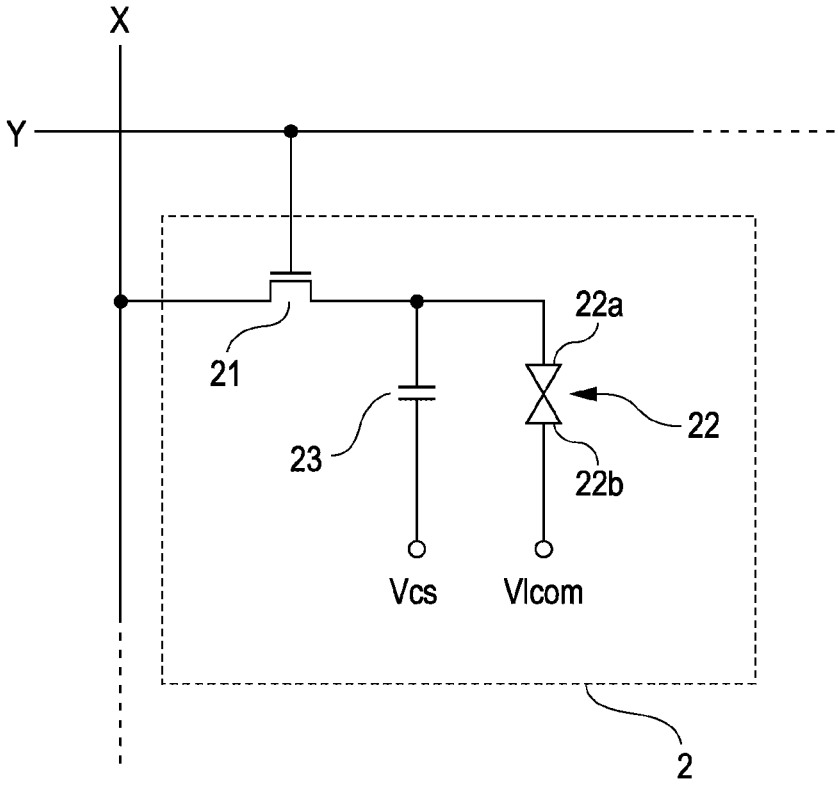
FIG. 5 is a circuit diagram illustrating a structure of a pixel portion.
Figure 6:
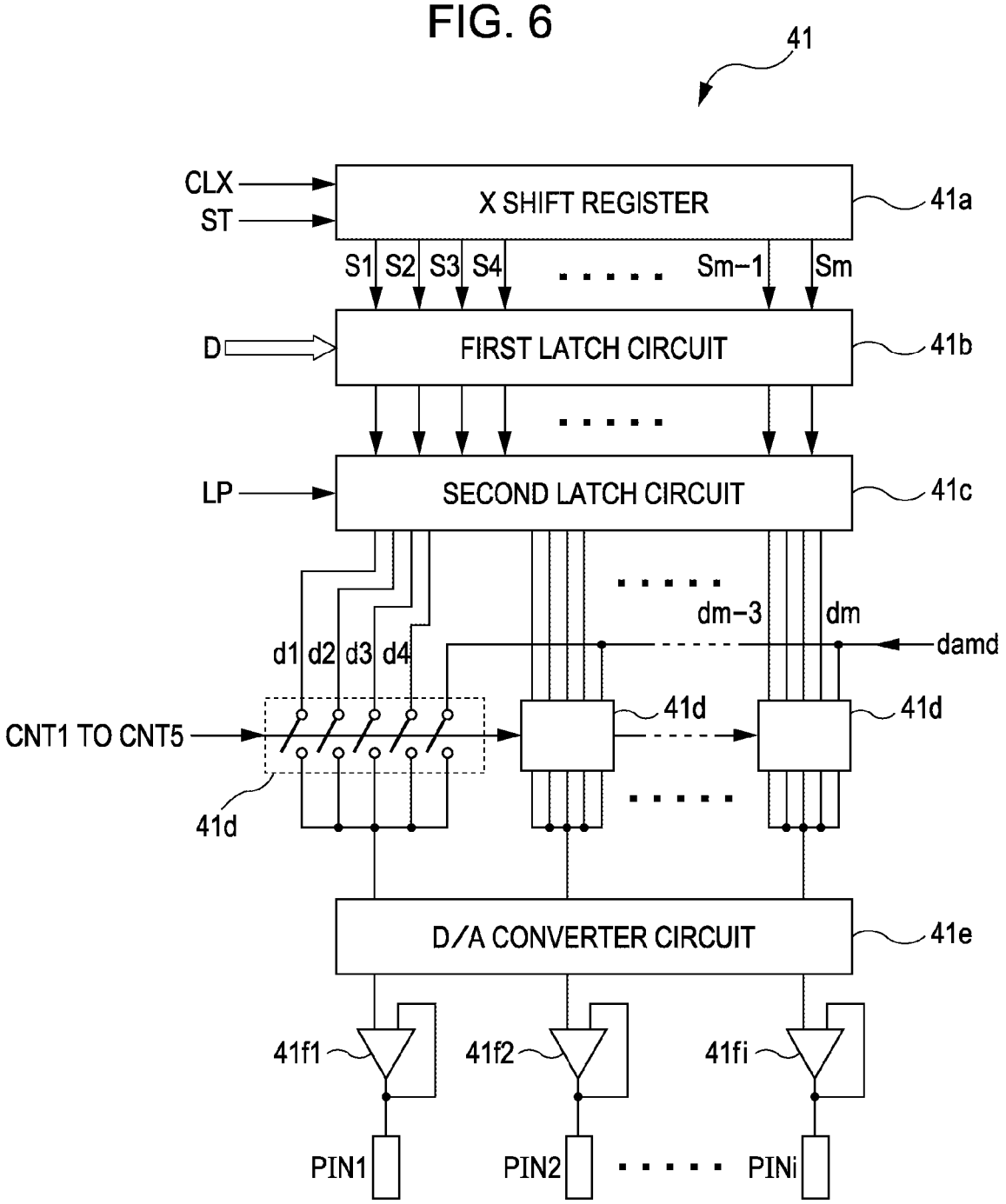
FIG. 6 is a block diagram illustrating a structure of a drive IC.
Figure 7:
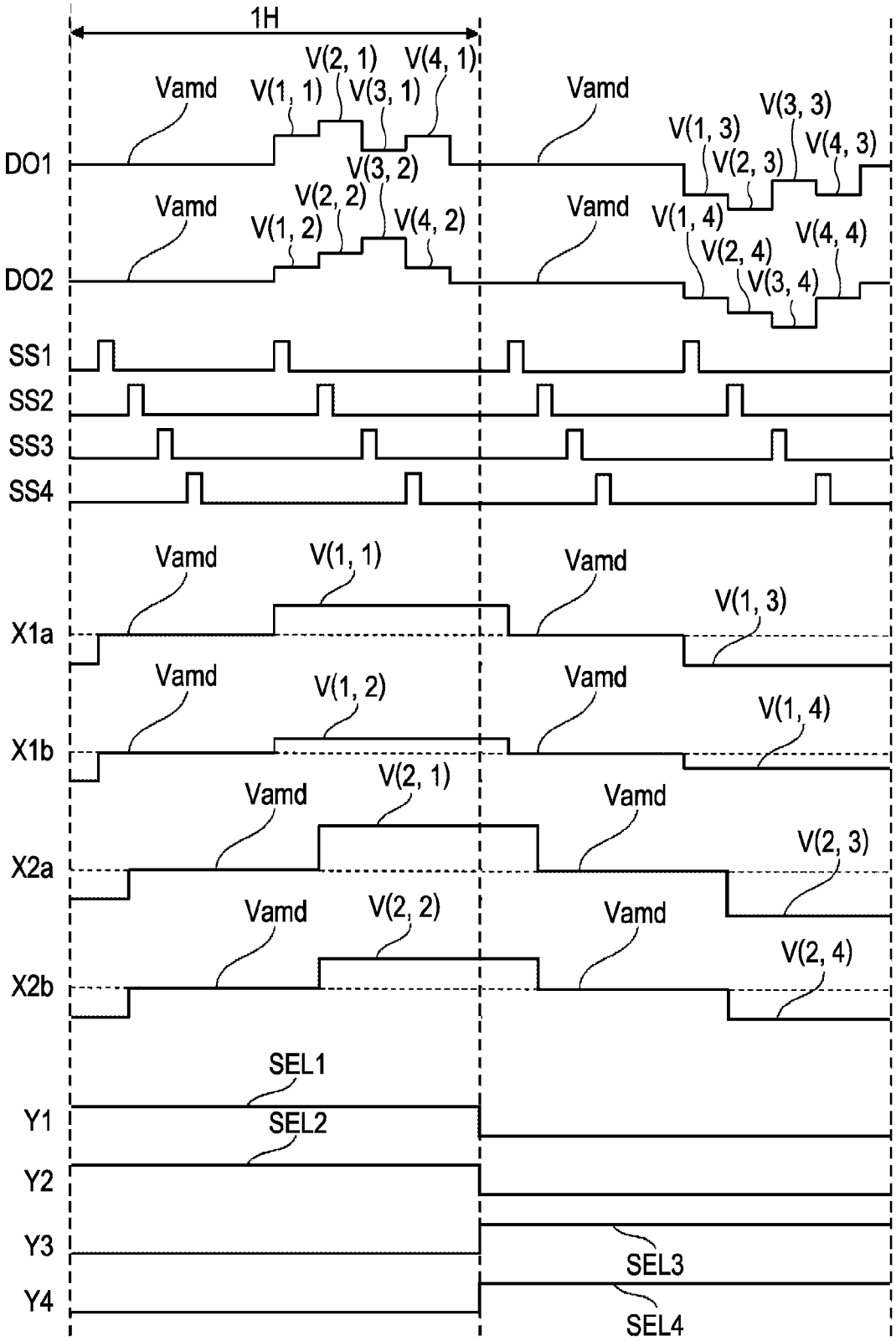
FIG. 7 is a timing chart illustrating time-divisional driving operation of the electro-optical device according to the first embodiment.

Next, a structure and an operation of an electro-optical device according to a first embodiment will be described with reference to FIGS. 3 to 7. FIG. 3 is a perspective view illustrating an entire structure of an electro-optical device according to the first embodiment. FIG. 4 is a circuit diagram illustrating a concrete structure of the electro-optical device according to the first embodiment. FIG. 5 is a circuit diagram illustrating a structure of a pixel portion. FIG. 6 is a block diagram illustrating a structure of a drive IC. FIG. 7 is a timing chart illustrating a time division operation of the electro-optical device according to the first embodiment.

In FIG. 3, the electro-optical device according to the first embodiment includes a flexible substrate 200 which is the above-mentioned electro-optical panel and a drive IC 41 which is an example of "integrated circuit" of the invention.

The flexible substrate 200 is electrically connected to the electro-optical panel via the external circuit connection terminals 102. An end of the flexible substrate 200 which is not connected to the electro-optical panel is electrically connected to a circuit substrate (not shown). That is, the image signals are supplied to the electro-optical panel from the circuit substrate via the flexible substrate 200.

The drive IC 41 is provided on the flexible substrate 200, and has a structure called an image signal supply device or an image signal supply circuit for the electro-optical panel. In addition, the drive IC 41 may be structured so as to perform correction processing, such as gamma correction and serial-parallel conversion. Alternatively, the drive IC 41 may be structured using a circuit or a device incorporated in the electro-optical panel. In such a case, the drive IC 41 may be structured including the time division circuit 42 and the scan line drive circuit 104. A structure of the drive IC 41 will be described in greater detail below.

In FIG. 4, m dots×n lines of pixel portions 2 are arranged in a matrix (in a plane) in the image display area 10*a*. Further, each of n scan lines Y1 to Yn extends in a row direction (X direction) in the image display area 10*a*. That is, one row of pixel portions 2 are placed so as to correspond to a single scan line Y. Still further, 2m data lines X1*a*, X1*b*, X2*a*, X2*b*, . . . , Xma, and Xmb are provided in the image display area 10*a* in a manner such that each of the data lines extends in a column direction (Y direction). That is, two data lines X are placed for one column of pixel portions 2 (referred to as "pixel column"). That is, two data lines Xia and Xib are provided for the i-th column (I=1, . . . , and m) of pixel portions 2.

Hereinafter, when specifically denoting a certain pixel portion 2 within the image display area 10*a*, subscripts 1 to m for the data lines X and subscripts 1 to n for the scan lines Y are used, and the pixel is expressed as an intersection between the subscripts (1 to m, 1 to n). For example, the left uppermost pixel portion 2 of the figure is (1, 1) and the right lowermost pixel portion 2 is (m, n).

In FIG. 5, one pixel portion 2 is a TFT 21 which is a switching element and includes a liquid crystal capacitor 22 and a storage capacitor 23.

A source of the TFT 21 is connected to one data line X, and a gate of the TFT 21 is connected to one scan line Y. In the pixel portions 2 arranged in a single row, gates of the TFTs 21 are connected to a single scan line Y. In the pixel portions 2 arranged in a single column, sources of the TFTs 21 are connected to two different data lines X. Drains of the TFTs 21 are connected to the liquid crystal capacitors 22 and the storage capacitors 23 which are provided in parallel with each another in common.

The liquid crystal capacitor 22 includes the pixel electrode 22*a*, the opposing electrode 22*b*, and the liquid crystal layer 50 interposed between the electrodes 22*a* and 22*b*. The storage capacitor 23 is formed by the pixel electrode 22*a* and a common capacitor electrode (not shown) and is supplied with a voltage Vcs. Thanks to the storage capacitor 23, it is possible to suppress influence of leakage of charges accumulated in the liquid crystal. On the other hand, the pixel electrode 22*a* is applied with a data voltage via the TFT 21, and the liquid crystal capacitor 22 and the storage capacitor 23 are charged according to the applied voltage level. Transmittance of the liquid crystal layer is set according to a potential difference between the pixel electrode 22*a* and the opposing electrode 22*b* (a voltage applied to the liquid crystal), and gradation of the pixel portion 2 is set.

With reference to FIG. 4, the pixel portions 2 are driven by an alternate current (AC) driving method in which a voltage polarity is reversed in every predetermined period in order to expand the life span of the liquid crystal. The voltage polarity is determined on the basis of an orientation of electric field which is applied to the liquid crystal layer 50, i.e. positive and negative polarities of the application voltage of the liquid crystal layer 50. With this embodiment, a common DC driving method which is a kind of the AC driving method is adopted. That is, a driving method, in which a voltage Vlcom applied to the opposing electrode 22*b* and a voltage Vcs applied to the common capacitor electrode are maintained at constant levels and a polarity of the pixel electrode 22*a* is reversed, is adopted.

The control circuit 5 synchronously controls the scan line drive circuit 104, the data line drive circuit 101, and the frame memory 6 on the basis of a vertical synchronous signal Vs, a horizontal synchronous signal Hs, and a dot clock signal DCLK inputted by a higher-level device (not shown). The scan line drive circuit 104 and the data line drive circuit 101 under the synchronous control cooperate to perform display control of a displaying portion 1. With this embodiment, a double speed driving method in which a refresh rate (i.e. vertical synchronous frequency) is set to 120 Hz which is twice a normal frequency is adopted in order to suppress flicking by performing fast display. In this case, a single frame (i.e. 1/60 seconds) determined by the vertical synchronous signal Vs consists of two fields. In a single frame, two times of line sequential scanning are performed.

The scan line drive circuit 104 is mainly composed of a shift resistor and an output circuit. The scan line drive circuit 104 sequentially selects the scan lines Y1 to Yn one by one by outputting a scan signal SEL to each of the scan lines Y1 to Yn in every single horizontal scan period (1H). Further, as described below, with this embodiment, two scan lines Y are selected in 1H. The scan signal SEL has a binary level composing of a high potential level "H level" and a low potential level "L level". The scan line Y corresponding to a pixel row which is an object of data writing is set to H level and each of the other scan lines Y are set to L level. The pixel rows which are an object of data writing are sequentially selected by the scan signal SEL and data written in the pixel portions 2 is maintained over one field.

The frame memory 6 has m×n bits of memory space corresponding to resolution of the image display area 10*a* and stores and holds display data input by the higher-level device in the unit of a frame. Data writing to the frame memory 6 and data reading from the frame memory 6 are controlled by the control circuit 5. The display data D which determines the gradation of the pixel portions 2 is, for example, 64 levels of gradation data composed of six bits D0 to D5. The display data D read out from the frame memory 6 is transmitted in series to the data line drive circuit 101 via a 6-bit bus.

The data line drive circuit 101 is provided at a latter stage of the frame memory 6 and is composed of the drive IC 41 and the time division circuit 42. The data line drive circuit 101 outputs data to be supplied to every pixel row which is an object of data writing to the data lines X1*a* to Xmb by acting together with the scan line drive circuit 104.

The drive IC 41 simultaneously performs outputting of data to a current pixel row to which data is to be written this time and point sequential latching (i.e. holding) of data relating a next pixel row to which data is to be written next time. A structure and an operation of the drive IC 41 will be described in greater detail below.

In FIG. 6, main circuits of an X shift resistor 41*a*, a first latch circuit 41*b*, a second latch circuit 41*c*, a changeover switch group 41*d*, a D/A converter circuit 41*e*, and the output circuit 41*f* are built in the drive IC 41. The X shift resistor 41*a* transmits a start signal ST supplied for the first time within 1H in response to the clock signal CLX, one of latch signals S1, S2, S3, . . . , and Sm is set to H level, and the others of the latch signals are set to L level. The first latch circuit 41*b* sequentially latches m 6-bit data D supplied as serial data at rising times of the latch signals S1, S2, S3, . . . , and Sm. The second latch circuit 41*c* simultaneously latches data latched by the first latch circuit 41*b* at a rising time of a latch pulse LP. The m pieces of latched data D are output in parallel with each other as data signals d1 to dm which are digital data in a next 1H from the second latch circuit 41*c*.

The data signals d1 to dm are grouped, for example, into as four-pixel time-series data by m/4 (=i) changeover switch groups 41*d*, each provided in the unit of four data lines. A single changeover switch group 41*d* is illustrated so as to include five switch sets, but actually includes five systems, each system including a 6-bit switch group. Since the six switches in a single system always operate in the same manner, hereinafter it will be described assuming six switches like one switch.

Not only four pixels of data signals (for example, d1 to d4) output from the second latch circuit 41*c* but also correction data damd are input to the changeover switch group 41*d*. The correction data damd is digital data which determines a voltage level of a correction voltage Vamd (so called pre-charge voltage). Conduction of five switches constituting the changeover switch group 41*d* is controlled by any one of five controls signals CNT1 to CNT5, and the five switches sequentially and selectively turn on at offset timing. In the 1H, sets of correction data damd and four-pixel data signals d1 to d4 are sequentially time-serialized in the order of damd, d1, d2, d3, and d4 and are time serially output from the changeover switch 41*d*.

The Digital to Analog (D/A) converter circuit 41*e* performs D/A conversion with respect to a series of digital data output from each of the changeover switch group 41*d* and generates a voltage as analog data. With this method, the correction data damd is converted to the correction voltage Vamd, and the data signals d1 to dm time-serialized in the unit of four pixels are converted to data voltages V1 to Vm.

Correction voltages Vamd and the data voltages V1 to Vm are amplified by i pieces of output circuits 41*f*1 to 41*fi* and time-serially output from output pins PIN1 to PINi.

As shown in FIG. 4, the output pins PIN1 to PINi of the drive IC 41 are connected to output lines DO1 to DOi. A single output line DO corresponds a group of data lines X, each corresponding to four pixel columns which are adjacent to one another. In greater detail, the output line DO1 is provided so as to correspond to four data lines X1*a*, X2*a*, X3*a*, and X4*a*. The output line DO2 is provided so as to correspond to four data lines X1*b*, X2*b*, X3*b*, and X4*b*. The output line DO3 is provided so as to correspond four data lines X5*a*, X6*a*, X7*a*, and X8*a*. The output line DO4 is provided so as to correspond to four data lines X5*b*, X6*b*, X7*b*, and X8*b*. The output line DO(i−1) is provided so as to correspond to four data lines X(m−3)a, X(m−2)a, X(m−1)a, and Xma. The output line DOi is provided so as to correspond to four data lines X(m−3)b, X(m−2)b, X(m−1)b, and Xmb. In other words, the output circuit 41*f*1 (see FIG. 6) corresponds to four data lines X1*a*, X2*a*, X3*a*, and X4*a*, the output circuit 41*f*2 corresponds to four data lines X1*b*, X2*b*, X3*b*, and X4*b*, the output circuit 41*f*3 corresponds to four data lines X5*a*, X6*a*, X7*a*, and X8*a*, the output circuit 41*f*4 corresponds to four data lines X5*b*, X6*b*, X7*b*, and X8*b*, the output circuit 41*f*(i−1) corresponds to four data lines X(m−3a, X(m−2)a, X(m−1)a, and Xma, and the output circuit 41*fi* corresponds to four data lines X(m−3)b, X(m−2)b, X(m−1)b, and Xmb.

The time division circuit 42 is provided between the output line DO and the grouped data lines X in the unit of an output line.

The time division circuit 42 has four selection switches corresponding to the number of grouped data lines X, and each of the selection switches is controlled to be conducted by any one of selection signals SS1 to SS4 output from the control circuit 5. The selection signals SS1 to SS4 determine an ON period of the selection switches in a single group, and are synchronized with the time series signal output from the drive IC 41. Hereinafter, the description will be made, focusing on the output lines DO1 and DO2.

In FIG. 7, the leftmost time division circuit 42 connected to the output line DO1 supplies a correction voltage Vamd output to the output line DO1 for four data lines X1*a* to X4*a*. The correction voltage Vamd may be sequentially supplied as shown in the figure. Alternatively, the correction voltage may be supplied all at once. Next, the time division circuit 42 divides data voltages V1 to V4 of four pixels in a time-shared manner, and distributes the obtained data voltages V to the data lines X1*a* to X4*a*. In greater detail, the scan signal SEL1 becomes H level in the first 1H of one field and the uppermost scan line Y1 is selected. In this 1H, the output line DO1 is supplied with the correction voltage Vamd first, and then sequentially supplied with data voltages V1 to V4 (corresponding to V(1,1), V(2,1), V(3,1), and V(4,1) in the first 1H) of four pixels corresponding to intersections of the data lines X1*a* to X4*a* and the scan line Y1, respectively.

While the voltage supply to the output line DO1 is performed, the output line DO2 is also supplied with a voltage. The time division circuit 42 connected to the output line DO2 supplies the output correction voltage Vamd to the output line DO2 for four data lines X1*b* to X4*b* first. Next, the time division circuit 42 divides the data voltages V1 to V4 of four pixels in a time-shared manner, and distributes the obtained voltages V to the data lines X1*b* to X4*b*. In greater detail, the scan signal SEL2 becomes H level and the second uppermost scan line Y2 is selected during the first 1H of one field. In this 1H, the output line DO2 is supplied with the correction voltage Vamd first, and then sequentially supplied with data voltages V1 to V4 (corresponding to V(1,2), V(2,2), V(3,2), and V(4,2) in the first 1H) of four pixels corresponding to intersections of the data lines X1*b* to X4*b* and the scan line Y2.

With this embodiment, voltages output from different pins PIN of the driver IC 41 are simultaneously supplied to two pixels portions 2 neighboring one another in a column direction (Y direction). That is, the correction voltage Vamd and the data voltage are simultaneously supplied from the different output circuits 41*f*. Hereinafter, the supply of each voltage will be described in a time series manner.

In the state in which the correction voltage Vamd is output to the output line DO1, the selection signals SS1 to SS4 sequentially become H level in the order of SS1, SS2, SS3, and SS4, and four switches constituting the time division circuit 42 turn on in turns. In this manner, the correction voltages Vamd output from the output lines DO1 and DO2 are sequentially supplied to the data lines X1*a* to X4*a* and X1*b* to X4*b*. That is, the correction voltages Vamd are simultaneously supplied to the data lines X1*a* and X1*b*. In a similar manner, the correction voltages Vamd are simultaneously supplied to a set of data lines X2*a* and X2*b*, a set of data lines X3*a* and X3*b*, and a set of data lines X4*a* and X4*b*. The correction voltage Vamd is a voltage for reducing influence of vertical crosstalk (display unevenness in a column direction) and is set to a constant value, 0 V in this embodiment.

Next, in the state in which the data voltage V(1,1) is output to the output line DO1, only the selection signal SS1 becomes H level, and only a switch corresponding to the data line X1*a* of the switches constituting the time division circuit 42 turns on. In this manner, the data voltage V(1,1) output from the output line DO1 is supplied to the data line X1*a*, and data writing to the pixel portion (1,1) is performed according to the data voltage V(1,1). While the data voltage V(1,1) is output to the output line DO1, the data lines X2*a*, X3*a*, and X4*a* are maintained at the correction voltage Vamd as switches corresponding to the data lines X2*a*, X3*a*, and X4*a* are in an OFF state.

Simultaneously, the output line DO2 is supplied with the data voltage V(1,2), and only a switch corresponding to the data line X1*b* of switches constituting the time division circuit 42 turns on. In this manner, the data voltage V(1,2) output to the output line DO2 is supplied to the data line X1*b*, and data writing to the pixel portion (1,2) is performed according to the data voltage V(1,2). While the output line DO2 is supplied with the data voltage V(1,2), the data lines X2*a*, X3*a*, and X4*a* are maintained at the correction voltage Vamd as the switches corresponding to the data lines X2*b*, X3*b*, and X4*b* are in an OFF state.

Next, in the state in which the data voltage V(2, 1) is output to the output line DO1, only the selection signal SS2 becomes H level, and thus only a switch corresponding to the data line X2*a* of switches constituting the time division circuit 42 turns on. In this manner, the data voltage V(2, 1) output to the output line DO1 is supplied to the data line X2*a* and the data writing to the pixel portion (2, 1) is performed according to the data voltage V(2, 1). While the data voltage V(2, 1) is output to the output line DO1, since switches corresponding to the data lines X1*a*, X3*a*, and X4*a* maintain an OFF state, the data line X1*a* maintains the data voltage V(1, 1) and the data lines X3*a* and X4*a* maintain the correction voltage Vamd.

Simultaneously, the output line DO2 is supplied with the data voltage V(2, 2) and only a switch corresponding to the data line X2*b* of switches constituting the time division circuit 42 turns on. With this operation, the data voltage V(2, 3) output to the output line DO2 is supplied to the data line X1*b*, and the data writing to the pixel portion (2, 2) is performed according to the data voltage V(2, 2). While the data voltage V(2, 2) is output to the output line DO2, since switches corresponding to the data lines X1*b*, X3*b*, and X4*b* are in an OFF state, the data line X1*b* maintains the data voltage V(1, 2) and the data lines X3*b* and X4*b* maintain the correction voltages Vamd, respectively.

After that, although not shown, in a similar manner with the above described operation, the data writings to the pixel portions (3, 1) and (3, 2) are simultaneously performed. The data writings to the pixel portions (4, 1) and (4, 2) are simultaneously performed.

In a next 1H, the scan signals SEL3 and SEL4 become H level and therefore the third uppermost scan line Y3 and the forth uppermost scan line Y4 are selected. In this 1H, the output lines DO1 and DO2 are supplied with the correction voltages Vamd first. After that, the output line DO1 is sequentially supplied with data voltages V1 to V4 (V(1, 3), V(2, 3), V(3, 3), and V(4, 3) in 1H this time) output from four pixels corresponding to intersections of the data lines X1*a* to X4*a* and the scan line Y3. The output line DO2 is sequentially supplied with data voltages V1 to V4 (V(1, 4), V(2, 4), V(3, 4), and V(4, 4) in 1H this time) output from four pixels corresponding to the data lines X1*b* to X4*b* and the scan line Y3.

Processing in this 1H is similar to that in the previous 1H except that a polarity of voltages output to the output lines DO1 and DO2 is reverse to one another. The correction voltage Vamd is supplied and the time series data voltages are distributed. The succeeding processing is similar too. While the reversal of polarity is performed for every 1H until the lowermost scan line Yn is selected, the supply of the correction voltage Vamd to each of the pixel rows and the distribution of the data voltages V1 to V4 are sequentially performed.

In this manner, data writing to the pixel portions (1, 1), (1, 3), . . . , and (1, n−1) of pixel portions (1, 1) to (1, n) constituting a first column is performed according to data voltages V(1, 1), V(1, 3), . . . , and V(1, n−1) output from the data line DO1 (in other words, the output circuit 41*f*1). Further, data writing to the pixel portions (1, 2), (1, 4), . . . , and (1, n) is performed according to data voltages V(1, 2), V(1, 4), . . . , and V(1, n) output from the output line DO2 (in other words the output circuit 41*f*2). That is, data writing to a plurality of pixel portions (k, 1) to (k, n) constituting the k-th column is performed according to the data voltage output from two different output circuits 41*f*. Accordingly, it is possible to reduce luminance variance between pixel columns which is attributable to variance between outputs of the output circuits 41*f*1 to 41*fi* (i.e. deviation variance between original voltage values contained in data voltages output from output circuits 41*f*1 to 41*fi*). Accordingly, it is possible to suppress line-shaped display unevenness extending in a Y direction in the displayed image.

With respect to the output lines succeeding to the output line DO3, the same processing relating to the output lines DO1 and DO2 is performed except of a point in that distribution object voltages are V5 to V8, and distribution object data lines are X5*a* to X8*a* and X5*b* to X8*b*. This point is common for each system until the order of the output line DOi comes.

In FIG. 7, it is exemplified that a polarity of the voltage output from the output line DO1 is reversed for every 1H. However, such operation is similar to the case in which polarity reversal of the voltage is performed for every one field and in the case in which the polarity reversal is performed for every field. The voltages output to the output lines DO1 and DO2 may be reversed in their polarities.

As described above, in the electro-optical device according to this embodiment, voltages are supplied to pixel columns from two different output circuits 41*f*. Here, voltage variance generally occurs between outputs from different output circuits 41*f*. However, if the voltages are supplied in the above-described manner, average voltage variance between pixel columns is small in comparison with the case in which the voltage is supplied from a single output circuit 41*f* to each pixel column and the above-described method acts to level the average voltage. That is, it is possible to prevent the data voltage variance between output circuits 41*f* from resulting in luminance variance between pixel columns. Accordingly, in the image displayed in the image display area 10*a*, it is possible to prevent the line-shaped luminance unevenness in a direction of the data line from standing out. That is, it is possible to display a high quality image.

Second Embodiment

Figure 8:
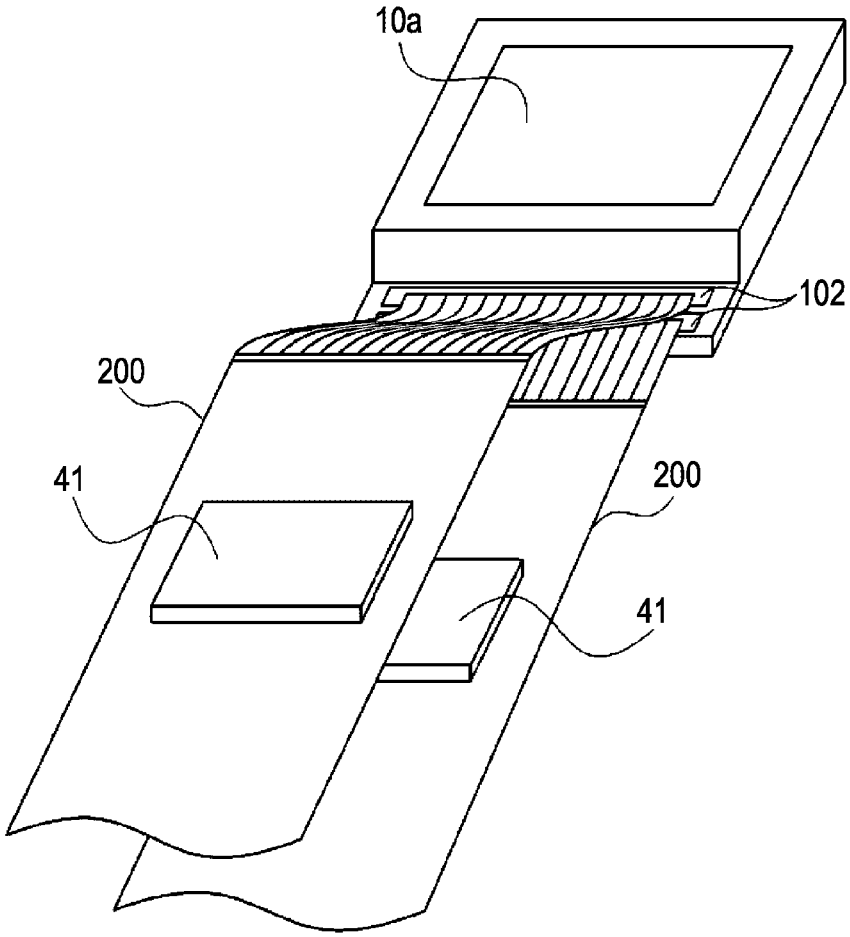
FIG. 8 is a perspective view illustrating an entire structure of an electro-optical device according to a second embodiment of the invention.
Figure 9:
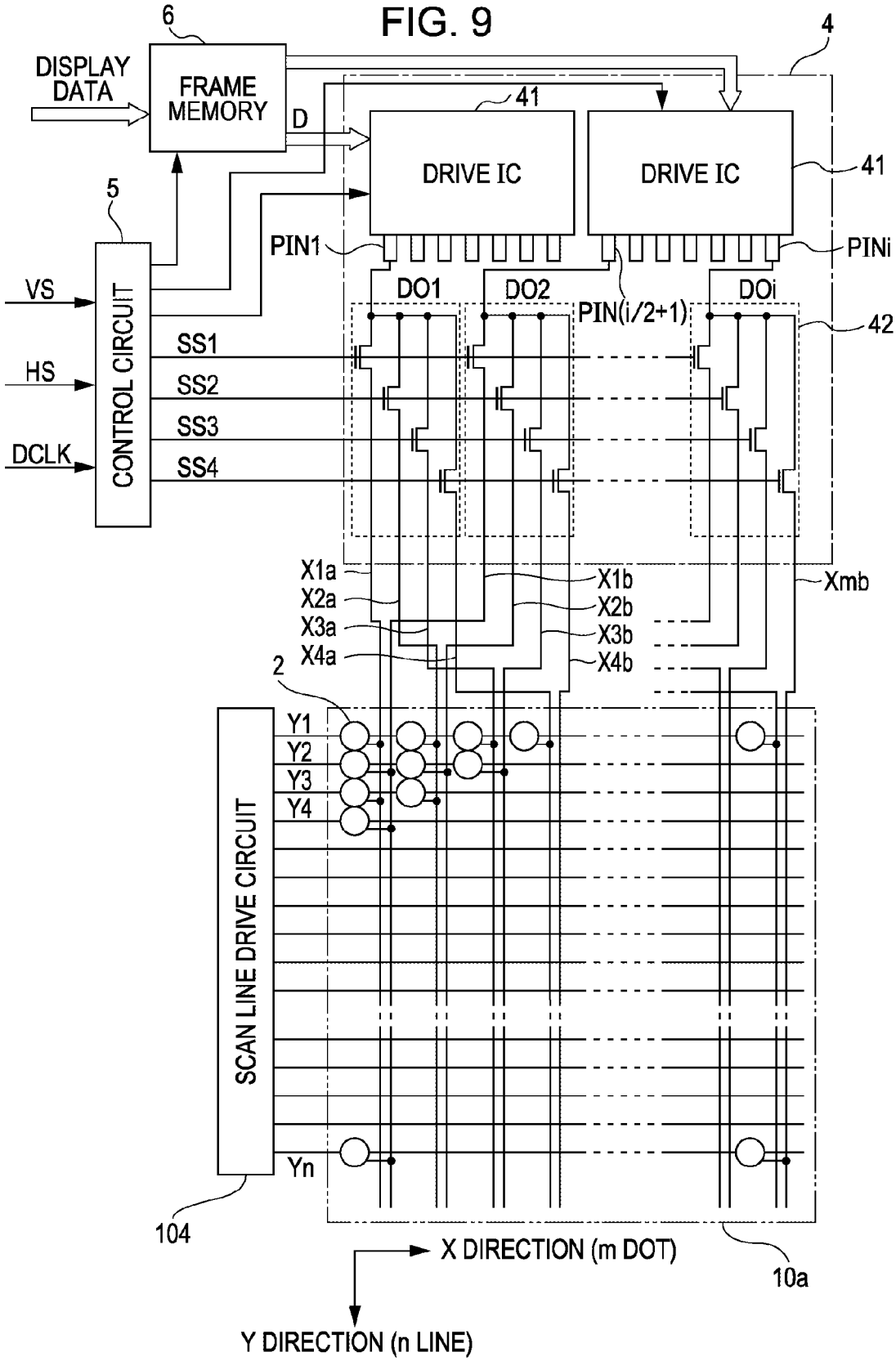
FIG. 9 is a circuit diagram illustrating a concrete structure of the electro-optical device according to the second embodiment.

Next, an electro-optical device according to the second embodiment will be described with reference to FIG. 8 and FIG. 9. FIG. 8 is a perspective view illustrating an entire structure of the electro-optical device according to the second embodiment. FIG. 9 is a circuit diagram illustrating a concrete structure of the electro-optical device according to the second embodiment. The second embodiment is different from the first embodiment in a structure of a drive IC, but other structures are the same. As for the second embodiment, points different from the first embodiment will be described. Repetitive description will be omitted. In FIG. 8 and FIG. 9, like elements between the first embodiment and the second embodiment are referenced with like references as in FIG. 3 and FIG. 4.

In FIG. 8, the electro-optical device according to the second embodiment is structured such that one electro-optical panel corresponds to two flexible substrates 200 and two drive ICs 41. In greater detail, external circuit connection terminals 102 are arranged in two columns in the electro-optical panel, and each column is electrically connected to the flexible substrate 200 with the drive IC 41 thereon.

With such a structure, the electro-optical panel can be driven by both of two drive ICs 41. Accordingly, in the case in which the number of wirings and external circuit connection terminals 102 increases as resolution definition of apparatuses becomes higher, it is possible to securely drive the electro-optical panel.

In FIG. 9, in the electro-optical device according to second embodiment, each of the two drive ICs 41 is applied with various kinds of signals output from the control circuit 5 and the frame memory 6. That is, the two drive ICs 14 are applied with signals relating to a display of the pixel portions 2 allocated thereto.

The two drive ICs are provided with the total i pieces of pins PIN. That is, one drive IC 41 is provided with i/2 pieces of pins PIN. Each pin PIN is supplied with voltages output from different output circuits 41 like the above-mentioned first embodiment. As shown in the figure, the leftmost pin PIN1 of the drive IC 41 at left side is electrically connected to the output line DO1. The rightmost pin PIN (i/2+1) of the drive IC 41 at right side is electrically connected to the output line DO2. In this manner, output pins PIN of the drive IC 41 at left side is connected to odd-numbered output lines, and output pins PIN of the drive IC 41 at right side are connected to even-numbered output lines. Accordingly, data voltages are supplied to the data lines Xka (k=1, . . . , and m) from output circuits 41*f*1, 41*f*3, . . . , and 41*f*(i−1) included in the drive IC 41 at left side, and supplied to the data lines Xkb (k=1, . . . , and m) from output circuits 41*f*2, 41*f*4, . . . , and 41*f*i included in the drive IC 41 at the right side.

When the electro-optical device according to the second embodiment operates, voltages are simultaneously applied to the pixel portions 2 neighboring one another in a column direction (Y direction) like the first embodiment. For example, voltages are simultaneously output to the data lines X1*a* and X1*b*. For such a reason, the pixel portions 2 neighboring one another in the pixel column are supplied with voltages from different drive ICs 41. That is, it can be described such that the pixel portions 2 neighboring one another in the pixel column are simultaneously supplied with voltages from the different output circuits 41*f*, respectively.

Here, the data voltage variance for every output circuit 41*f* is typically output variance in the single drive IC 41 and is smaller than the output variance occurring among different drive ICs 41. However, as described above, in the electro-optical device according to the second embodiment, a single pixel column is supplied with voltages from different output circuits 41*f*. Accordingly, like the electro-optical device according to the first embodiment, it is possible to prevent the data voltage variance between every output circuit 41*f* from resulting in luminance variance between every pixel column. Accordingly, in the image displayed in the image display area 10*a*, it is possible to prevent the line-shaped luminance unevenness in a direction of the data line from standing out. That is, it is possible to display a high quality image.

Electronic Apparatus

Figure 10:
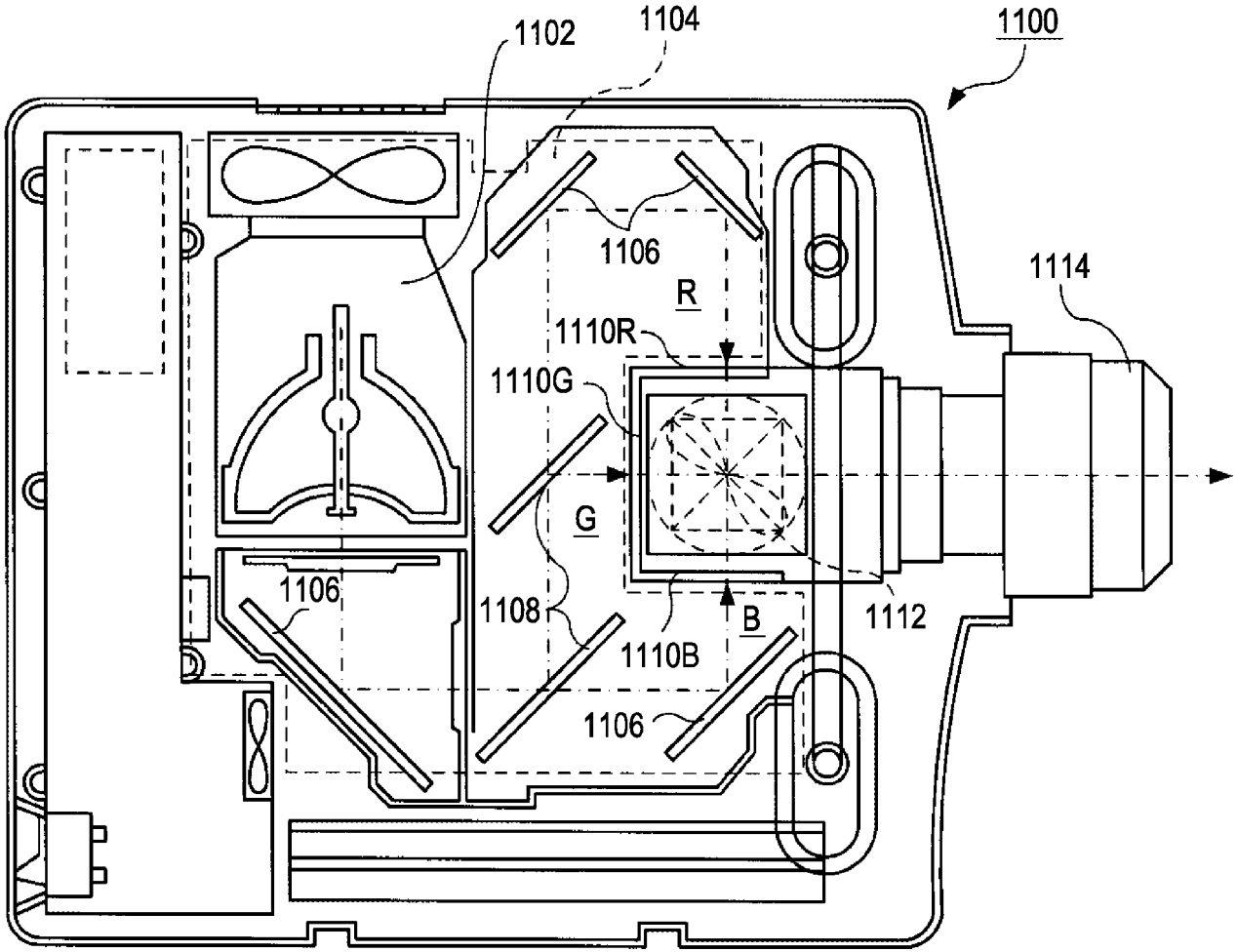
FIG. 10 is a plan view illustrating a structure of a projector which is an example of an electronic apparatus to which an electro-optical device is applied.

Next, cases in which a liquid crystal device, the above-described electronic-optical device, is applied to various kinds of electronic apparatuses will be described. FIG. 10 is a plan view illustrating an exemplified structure of a projector. Hereinafter, a projector in which the liquid crystal device is used as a light valve will be described.

As shown in FIG. 10, a lamp unit 1102 made up of white light sources, such as a halogen lamp is provided inside the projector 1100. Transmitted light exiting from the lamp unit 1102 is split into three primary colors of RGB by four mirrors 1106 and two dichroic mirrors 1108 placed in a light guide 1104, and enter liquid crystal panels 1110R, 1110B, and 1110G serving as light valves corresponding primary colors.

The structure of each of the liquid crystal panels 110R, 1110B, and 1110G is the same as the above-described liquid crystal device and is driven by any of primary color signals R, G, and B supplied from the image signal processing circuit. The light modulated by these liquid crystal panels enters a dichroic prism 1112 in three directions. In the dichroic prism 1112, R and B light components are reflected at a right angle (90°) but G light component progresses straight. Accordingly, all color components of the image are synthesized and therefore the color image, such as a screen is projected via a projection lens 1114.

Focusing on a display image by the liquid crystal panels 1110R, 1110B, and 1110G, a display image by the liquid crystal panel 1110G must be reversed left and right with respect to the display images by the liquid crystal panels 1110R and 1110B.

Light corresponding to R, G, and B primary colors enters the liquid crystal panels 1110R, 1110B, and 1110G by a dichroic mirror 1108. Accordingly, there is no need for a color filter.

Besides the electronic apparatus with reference to FIG. 10, it is no doubt that the electro-optical device according to the invention also can be applied to a mobile-type personal computer, a cellular phone, a liquid crystal television set, a viewfinder-type or a monitor-type video tape reorder, a car navigation device, a pager, an electronic organizer, a calculator, a word processor, a workstation, a television phone, a POS terminal, and apparatuses with a touch panel.

Besides the liquid crystal device described in the above-mentioned embodiments, the invention can be applied to a reflective liquid crystal device (LCOS), a plasma display (PDP), an electric field emission display (FED, SED), an organic electroluminescence display (OLED), a digital micro-mirror device (DMD), and an electrophoresis display.

The invention is not limited to the above-mentioned embodiments and can be modified as long as it does not conflict with the spirit of the invention construed from all over the claims and specification. The modifications of the electro-optical device, the driving method of an electro-optical device, and the electronic apparatus will be within the technical scope of the invention.

The entire disclosure of Japanese Patent Application No. 2008-003557, filed Jan. 10, 2008 is expressly incorporated by reference herein.

What is claimed is:

1. An electro-optical device comprising:

a first output circuit;

a second output circuit;

a first data line;

a second data line;

a third data line;

a fourth data line;

a first pixel column that is arranged alongside the first data line and the second data line, the first pixel column including a first pixel and a second pixel; and a second pixel column that is arranged alongside the third data line and the fourth data line, the second pixel column including a third pixel and a fourth pixel, the first output circuit supplying a first data signal that is supplied to the first pixel through the first data line, the second output circuit supplying a second data signal that is supplied to the second pixel through the second data line, the first output circuit supplying a third data signal that is supplied to the third pixel through the third data line, and the second output circuit supplying a fourth data signal that is supplied to the fourth pixel through the fourth data line.

2. The electro-optical device according to claim 1, wherein the first pixel column has the first pixel and the second pixel in a first direction, the first pixel column having no pixel in a second direction that intersects the first direction, and the second pixel column has the third pixel and the fourth pixel in the first direction, the second pixel column having no pixel in the second direction that intersects the first direction.

3. The electro-optical device according to claim 1, further comprising:

a first switch;

a second switch;

a third switch; and a fourth switch, the first data line being electrically connected to the first output circuit through the first switch according to a first selection signal, the second data line being electrically connected to the second output circuit through the second switch according to a second selection signal, the third data line being electrically connected to the first output circuit through the third switch according to a third selection signal, and the fourth data line being electrically connected to the second output circuit through the fourth switch according to a fourth selection signal.

4. The electro-optical device according to claim 1, further comprising:

a first integrated circuit provided with the first output circuit; and a second integrated circuit provided with the second output circuit.

5. The electro-optical device according to claim 4, further comprising:

a first substrate; and a second substrate that is electrically connected to the first substrate, the first data line, the second data line, the third data line, the fourth data line, the first pixel column, and the second pixel column being provided on the first substrate, and the first integrated circuit and the second integrated circuit being provided on the second substrate.

6. The electro-optical device according to claim 4, further comprising:

a first substrate; and a second substrate that is electrically connected to the first substrate, a third substrate that is electrically connected to the first substrate, the first data line, the second data line, the third data line, the fourth data line, the first pixel column, and the second pixel column being provided on the first substrate, the first integrated circuit being provided on the second substrate, and the second integrated circuit being provided on the third substrate.

7. The electro-optical device according to claim 1, wherein the first pixel includes a first pixel electrode, the second pixel includes a second pixel electrode, the third pixel includes a third pixel electrode, and the fourth pixel includes a fourth pixel electrode.

8. An electronic device provided with the electro-optical device according to claim 1.

9. An electro-optical device comprising:

a first output pin;

a second output pin;

a first data line;

a second data line;

a third data line;

a fourth data line;

a first pixel column that is arranged alongside the first data line and the second data line, the first pixel column including a first pixel and a second pixel; and a second pixel column that is arranged alongside the third data line and the fourth data line, the second pixel column including a third pixel and a fourth pixel, the first output pin supplying a first data signal that is supplied to the first pixel through the first data line, the second output pin supplying a second data signal that is supplied to the second pixel through the second data line, the first output pin supplying a third data signal that is supplied to the third pixel through the third data line, and the second output pin supplying a fourth data signal that is supplied to the fourth pixel through the fourth data line.

10. The electro-optical device according to claim 9, wherein the first pixel column has the first pixel and the second pixel in a first direction, the first pixel column having no pixel in a second direction that intersects the first direction, and the second pixel column has the third pixel and the fourth pixel in the first direction, the second pixel column having no pixel in the second direction that intersects the first direction.

11. The electro-optical device according to claim 9, further comprising:

a first switch;

a second switch;

a third switch; and a fourth switch, the first data line being electrically connected to the first output pin through the first switch according to a first selection signal, the second data line being electrically connected to the second output pin through the second switch according to a second selection signal, the third data line being electrically connected to the first output pin through the third switch according to a third selection signal, and the fourth data line being electrically connected to the second output pin through the fourth switch according to a fourth selection signal.

12. The electro-optical device according to claim 9, further comprising:

an integrated circuit provided with the first output pin and the second output pin.

13. The electro-optical device according to claim 12, further comprising:

a first substrate; and a second substrate that is electrically connected to the first substrate, the first data line, the second data line, the third data line, the fourth data line, the first pixel column, and the second pixel column being provided on the first substrate, and the integrated circuit being provided on the second substrate.

14. The electro-optical device according to claim 9, the first pixel including a first pixel electrode, the second pixel including a second pixel electrode, the third pixel including a third pixel electrode, and the fourth pixel including a fourth pixel electrode.

15. An electronic device provided with the electro-optical device according to claim 9.

16. An electro-optical device comprising:

a first output circuit;

a second output circuit;

a first data line;

a second data line;

a third data line;

a fourth data line;

a first pixel electrode column that is arranged alongside the first data line and the second data line, the first pixel electrode column including a first pixel electrode and a second pixel electrode; and a second pixel electrode column that is arranged alongside the third data line and the fourth data line, the second pixel electrode column including a third pixel electrode and a fourth pixel electrode, the first output circuit supplying a first data signal that is supplied to the first pixel electrode through the first data line and a fifth switch corresponding to the first pixel electrode, the second output circuit supplying a second data signal that is supplied to the second pixel electrode through the second data line and a sixth switch corresponding to the second pixel electrode, the first output circuit supplying a third data signal that is supplied to the third pixel electrode through the third data line and a seventh switch corresponding to the third pixel electrode, and the second output circuit supplying a fourth data signal that is supplied to the fourth pixel electrode through the fourth data line and an eighth switch corresponding to the fourth pixel electrode.

17. An electronic device provided with the electro-optical device according to claim 16.

18. An electro-optical device comprising:

a first output pin;

a second output pin;

a first data line;

a second data line;

a third data line;

a fourth data line;

a first pixel electrode column that is arranged alongside the first data line and the second data line, the first pixel electrode column including a first pixel electrode and a second pixel electrode; and a second pixel electrode column that is arranged alongside the third data line and the fourth data line, the second pixel electrode column including a third pixel electrode and a fourth pixel electrode, the first output pin supplying a first data signal that is supplied to the first pixel electrode through the first data line and a fifth switch corresponding to the first pixel electrode, the second output pin supplying a second data signal that is supplied to the second pixel electrode through the second data line and a sixth switch corresponding to the second pixel electrode, the first output pin supplying a third data signal that is supplied to the third pixel electrode through the third data line and a seventh switch corresponding to the third pixel electrode, and the second output pin supplying a fourth data signal that is supplied to the fourth pixel electrode through the fourth data line and an eighth switch corresponding to the fourth pixel electrode.

19. An electronic device provided with the electro-optical device according to claim 18.

20. A method for controlling an electro-optical device including a first output circuit, a second output circuit, a first data line, a second data line, a third data line, a fourth data line, a first pixel column that is arranged alongside the first data line and the second data line, the first pixel column including a first pixel and a second pixel, and a second pixel column that is arranged alongside the third data line and the fourth data line, the second pixel column including a third pixel and a fourth pixel, the method comprising:

the first output circuit supplying a first data signal that is supplied to the first pixel through the first data line, the second output circuit supplying a second data signal that is supplied to the second pixel through the second data line, the first output circuit supplying a third data signal that is supplied to the third pixel through the third data line, and the second output circuit supplying a fourth data signal that is supplied to the fourth pixel through the fourth data line.

* * * * *